US005813078A

United States Patent [19]

Hogan, Sr.

[11] Patent Number: 5,813,078

[45] Date of Patent: Sep. 29, 1998

[54] SHOWER FOOT WASHER

[76] Inventor: Nicholas Shawyer Hogan, Sr., 413 N. Broadacres, Compton, Calif. 90220

[21] Appl. No.: 915,457

[22] Filed: Aug. 20, 1997

[51] Int. Cl.[6] ..... A47K 7/02

[52] U.S. Cl. ..... 15/160; 15/104.92; 4/606; 601/136; 601/154

[58] Field of Search ..... 15/104.92, 160, 15/161; 4/606; 601/136, 154

[56] References Cited

U.S. PATENT DOCUMENTS

| | | | |
|---|---|---|---|
| 210,072 | 11/1878 | Ziegler | 15/161 |
| D. 283,849 | 5/1986 | Miller | D4/120 |
| 2,852,793 | 9/1958 | Shelton | 15/104.92 |
| 3,548,439 | 12/1970 | Berst | 15/104.92 |
| 3,973,286 | 8/1976 | Logan | 15/88.3 |
| 4,520,525 | 6/1985 | Yogi et al. | 15/104.92 |
| 4,532,668 | 8/1985 | Slonicki | 15/104.92 |
| 4,617,917 | 10/1986 | Miller | 601/136 |
| 5,163,200 | 11/1992 | Carlin et al. | 15/104.92 |
| 5,177,829 | 1/1993 | Simpson | 15/104.92 |
| 5,321,867 | 6/1994 | Probst | 15/160 |
| 5,575,034 | 11/1996 | Biernacinski et al. | 15/215 X |

*Primary Examiner*—Mark Spisich
*Attorney, Agent, or Firm*—Goldstein & Canino

[57] ABSTRACT

A shower foot washer comprising a platform having a proximal portion, a distal portion, a top surface and a bottom surface. A casement extends upward from the top surface, along the distal portion, of the platform. A plurality of vertical partitions extend through the casement to the top surface of the platform, thus forming segmented portions within the casement. Brush extensions protrude from the vertical partitions to aid in the cleansing of one's foot and toes. A button is positioned on the casement, thus dispensing soap when pressed. A plurality of bores are positioned along the proximal portion of the platform. The bores extend from the top surface of the platform, through the platform, to the bottom surface. These bores allow for water and soap to drain through the shower foot washer. A plurality of suction cups are positioned along the bottom surface of the platform. These suction cups secure the washer to the bottom of a bathtub or shower stall, thus allowing the washer to be removed or conveniently positioned in the stall or tub.

1 Claim, 2 Drawing Sheets

SHOWER FOOT WASHER

BACKGROUND OF THE INVENTION

The invention relates to a shower foot washer. More particularly, the invention is a foot washer that enables one to cleanse their feet while in the shower safely and thoroughly.

One of the most neglected areas of the body, in terms of personal hygiene, is the feet. Because of the inconvenience of reaching them while showering, many people fail to properly cleanse their feet, thus resulting in numerous diseases, as well as discomfort, to the feet.

Many people find it difficult to effectively clean their feet while taking a shower. To wash one's feet properly, it is often necessary to stand on one foot while cleaning the other or to bend on one knee. Because of the water and soap present in the shower, standing on one foot can be quite dangerous. Many people end up slipping and hurting themselves as a result of trying to clean their feet.

While this can prove to be a difficult enough task for the average person, elderly persons, pregnant women and those with infirmities find cleansing their feet to be an impossible task. Thus, the feet are often neglected.

U.S. Pat. No. 3,973,286 to Logan discloses a foot cleaning apparatus having soap supply and brushing means. This invention allows a person to safely cleanse his/her feet while taking a shower.

U.S. Pat. No. 4,617,917 to Miller discloses a foot hygiene device enabling a user to clean and massage his/her feet while showering.

U.S. Pat. No. Des. 283,849 to Miller discloses a unique design for a foot hygiene device having a centrally disposed dorsal brush.

U.S. Pat. No. 5,163,200 to Carlin et al. discloses a foot scrubbing apparatus.

While these units may be suitable for the particular purpose employed, or for general use, they would not be as suitable for the purposes of the present invention as disclosed hereafter.

SUMMARY OF THE INVENTION

It is an object of the invention to produce a shower foot washer.

It is a further object of the invention to produce a shower foot washer which enables a user to safely and thoroughly cleanse his/her feet while taking a shower.

It is a further object of the invention to produce a shower foot washer having vertical brushes that aid in cleaning one's toes and foot.

It is a still further object of the invention to produce a shower foot washer having a soap dispenser that can be activated using one's foot.

It is a still further object of the invention to produce a shower foot washer having drain holes along the length of the washer that allows water and soap to pass through.

It is a still further object of the invention to produce a shower foot washer having suction cups along the bottom, therefore securing the washer to the floor of the shower.

The invention is a shower foot washer comprising a platform having a proximal portion, a distal portion, a top surface and a bottom surface. A casement extends upward from the top surface, along the distal portion, of the platform. A plurality of vertical partitions extend through the casement to the top surface of the platform, thus forming segmented portions within the casement. Brush extensions protrude from the vertical partitions to aid in the cleansing of one's foot and toes. A button is positioned on the casement, thus dispensing soap when pressed. A plurality of bores are positioned along the proximal portion of the platform. The bores extend from the top surface of the platform, through the platform, to the bottom surface. These bores allow for water and soap to drain through the shower foot washer. A plurality of suction cups are positioned along the bottom surface of the platform. These suction cups secure the washer to the bottom of a bathtub or shower stall, thus allowing the washer to be removed or conveniently positioned in the stall or tub.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
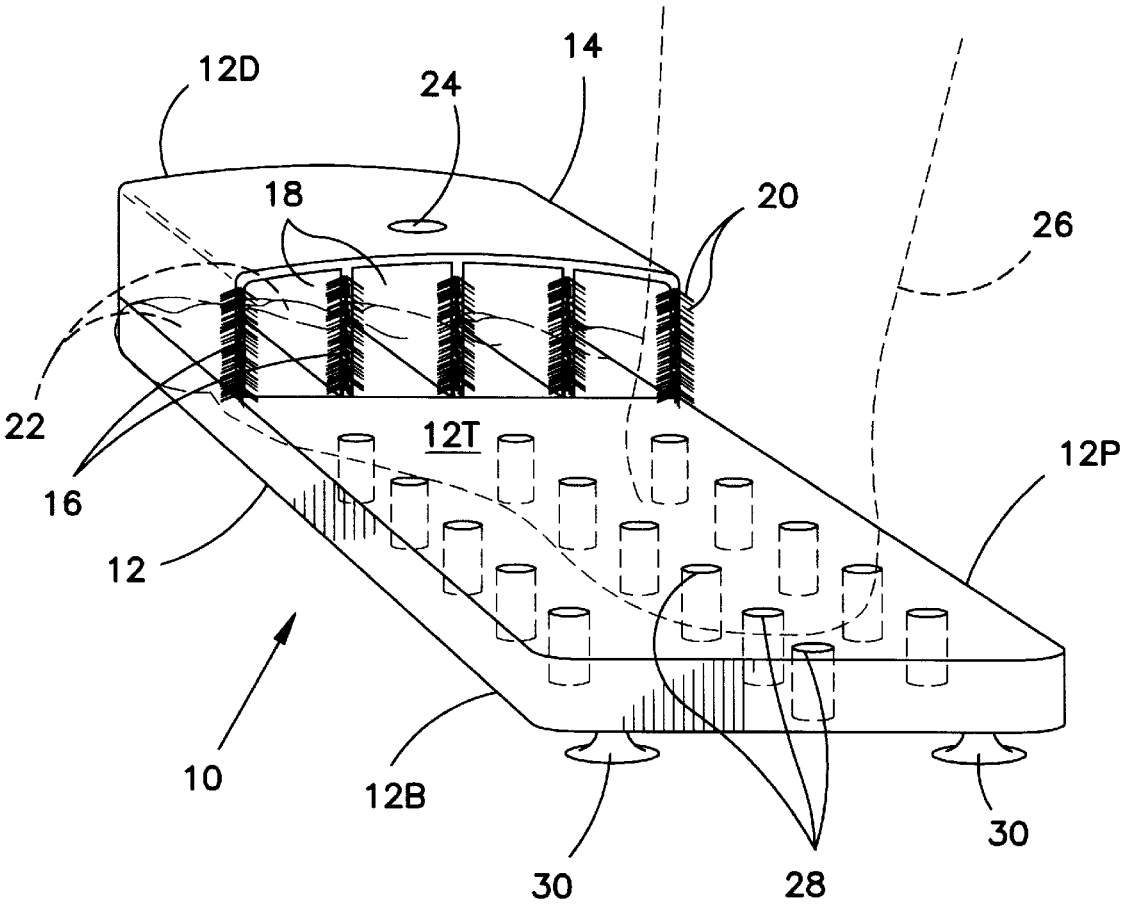
FIG. 1 is a perspective view of the shower foot washer with a foot shown in broken lines, illustrating the cleansing of toes.

FIG. 1 illustrates a perspective view of a shower foot washer 10 comprising a platform 12, having a proximal portion 12P, a distal portion 12D, a top surface 12T and a bottom surface 12B. A casement 14 extends upward from the top surface 12T, along the distal portion 12D, of the platform 12.

A plurality of vertical partitions 16 extend from the top of the casement 14 to the top surface 12T of the platform 12, thereby creating segmented portions 18 of the casement 14. Brush extensions 20 protrude from the individual partitions 16. FIG. 1 illustrates the manner in which one would use the brush extensions 20 of the shower foot washer 10. Individual toes 22 are inserted into the segmented portions 18. The brush extensions 20 lining the partitions 16 are used to cleanse the area in between the toes 22, as well as the toes 22 themselves.

A button 24 is positioned on the top of the casement 14. When this button 24 is pressed, soap is dispensed into the segmented portions 18 of the casement 14, thereby aiding in the cleansing of a foot 26 and toes 22.

The proximal portion 12P of the platform 12 of the shower foot washer 10 is the size of an average foot 26. A plurality of bores 28 are positioned along the proximal portion 12P of the platform 12. These bores 28 extend from the top surface 12T of the platform 12, through the platform 12 to the bottom surface 12B, thus allowing water and soap to drain through the platform 12 into a shower stall or bathtub.

Figure 2:
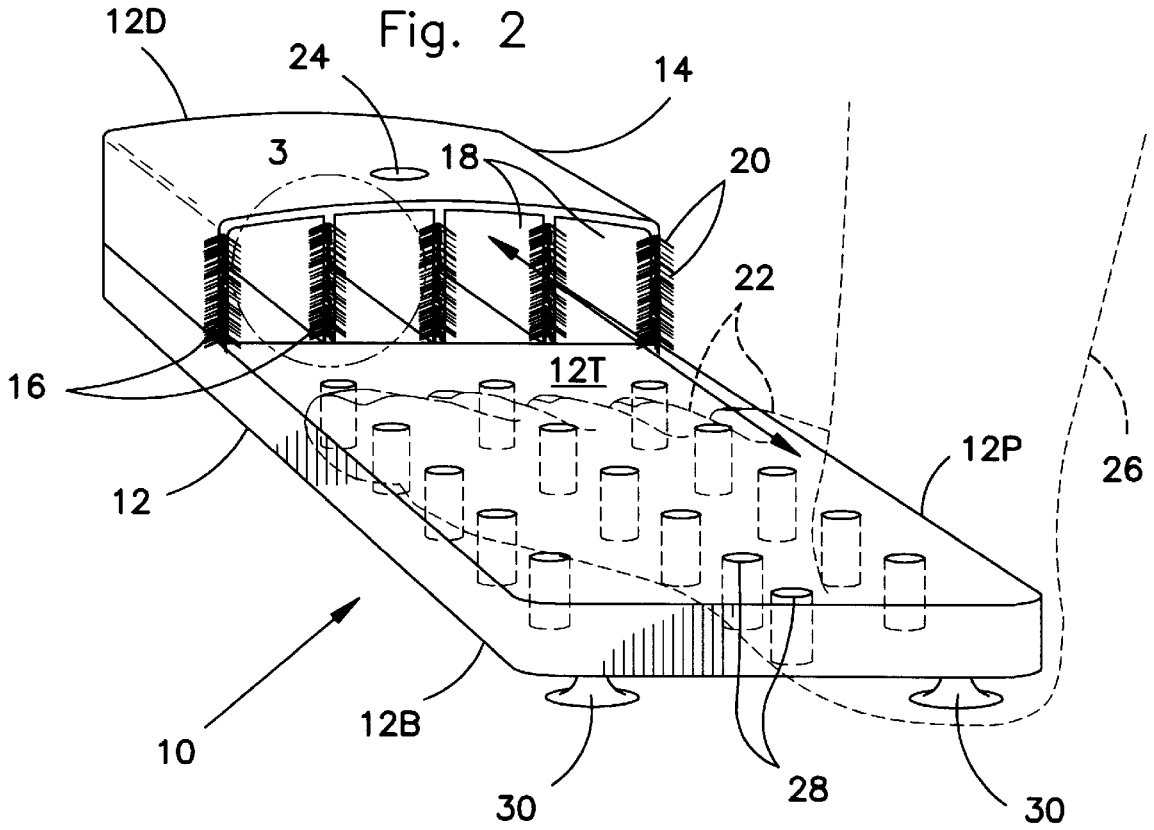
FIG. 2 is a perspective view of the shower foot washer with a foot shown in broken lines, illustrating the cleansing of the bottom of a foot.

FIG. 2 illustrates the use of the shower foot washer 10 to cleanse the bottom of a foot 26 by sliding one's foot 26 back and forth along the platform 12.

Figure 3:
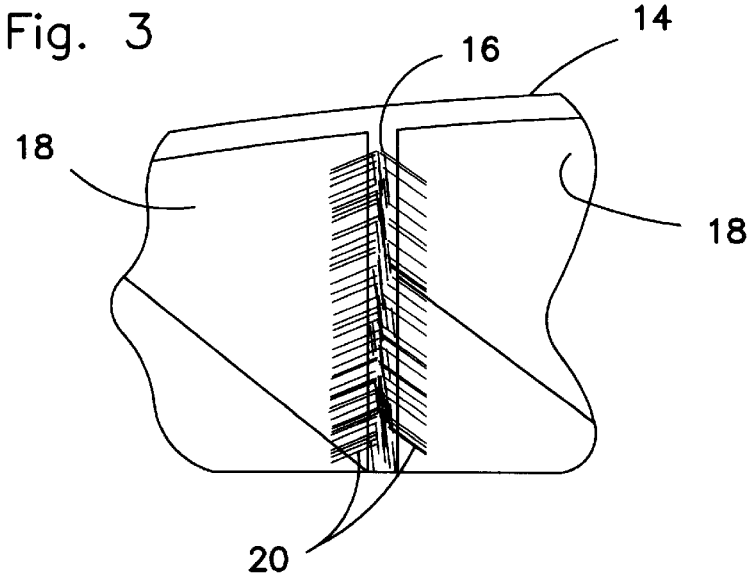
FIG. 3 is a blown up view of a portion of the shower foot washer taken along circle 3 of FIG. 2.

FIG. 3 illustrates a blown up view of the brush extensions 20 lining the vertical partitions 16. The brush extensions 20 are angled downward to most effectively clean in between one's toes 22. After the foot 26 is positioned on the top surface 12T of the proximal portion 12P of the platform 12, the toes 22 are inserted into the segmented portions 18 of the casement 14. The toes 22 can then be slid up and down along the brush extensions 20, thus scrubbing the toes 22 clean.

Suction cups 30 are positioned along the bottom surface 12B of the platform 12, as illustrated in FIGS. 1 and 2. These cups 30 allow the shower foot washer 10 to be secured to the bottom of a shower stall or bathtub. The shower foot washer 10 can then be strategically placed in the stall or tub to be most convenient for the user. It can also be removed from the stall or tub and replaced as needed.

What is claimed is:

1. A shower foot washer, for use in a shower stall or bathtub, comprising:

a platform, having a proximal portion, a distal portion, a top surface, and a bottom surface;

a casement extending upward from the top surface, along the distal portion, of the platform, the casement further including a top wall spaced above the top surface of the platform and extending across the distal portion thereof;

a plurality of vertical partitions, each partition extending from the top wall of the casement to the top surface of the platform, thereby creating segmented portions in the casement adapted to receive therein the toes of the user's foot; and brush extensions protruding from each of the vertical partitions for cleaning the user's toes as well as the areas therebetween.

* * * * *